US007685941B2

(12) United States Patent
Kienzler et al.

(10) Patent No.: US 7,685,941 B2
(45) Date of Patent: Mar. 30, 2010

(54) PROJECTILE WITH A PENETRATION CAPABILITY

(75) Inventors: Frank Martin Kienzler, Villingen-Schwenningen (DE); Alexander Zinell, Aichhalden (DE); Karl Kautzsch, Schwanstetten (DE); Gerhard Heussler, Zimmern-Stetten O.R. (DE); Klaus Bär, Lauf (DE)

(73) Assignees: Junghans Microtec GmbH, Dunningen-Seedorf (DE); Diehl BGT Defence GmbH & Co. KG, Ueberlingen (DE)

( * ) Notice: Subject to any disclaimer, the term of this patent is extended or adjusted under 35 U.S.C. 154(b) by 4 days.

(21) Appl. No.: 12/098,498

(22) Filed: Apr. 7, 2008

(65) Prior Publication Data

US 2008/0245257 A1 Oct. 9, 2008

(30) Foreign Application Priority Data

Apr. 5, 2007 (DE) ..... 10 2007 016 488
Feb. 15, 2008 (DE) ..... 20 2008 002 145 U

(51) Int. Cl.
*F42B 10/00* (2006.01)

(52) U.S. Cl. ..... 102/473; 102/475; 102/476; 102/272

(58) Field of Classification Search ..... 102/475, 102/476, 272, 499, 500
See application file for complete search history.

(56) References Cited

U.S. PATENT DOCUMENTS

| | | | | | |
|---|---|---|---|---|---|
| 2,595,757 | A * | 5/1952 | Brandt | 102/249 |
| 2,764,092 | A * | 9/1956 | Massey | 102/204 |
| 2,808,000 | A * | 10/1957 | Lindsay | 102/245 |
| 2,849,957 | A * | 9/1958 | Kuller et al. | 102/210 |
| 2,931,301 | A * | 4/1960 | Kuller et al. | 102/273 |
| 4,779,533 | A * | 10/1988 | Winterhalter et al. | 102/270 |
| 4,854,240 | A * | 8/1989 | Hirsch et al. | 102/476 |
| 4,967,666 | A * | 11/1990 | Kellner et al. | 102/476 |
| 5,196,646 | A * | 3/1993 | Worsey | 102/293 |
| 5,415,105 | A * | 5/1995 | Voss et al. | 102/476 |
| 6,578,488 | B2 * | 6/2003 | Strauss et al. | 102/272 |
| 2001/0054365 | A1 * | 12/2001 | Strauss et al. | 102/272 |
| 2007/0051268 | A1 * | 3/2007 | Bissig | 102/476 |
| 2008/0148985 | A1 * | 6/2008 | Schwantes et al. | 102/501 |
| 2008/0202324 | A1 * | 8/2008 | Steele | 89/1.11 |
| 2008/0308671 | A1 * | 12/2008 | Harnoy | 244/3.1 |

FOREIGN PATENT DOCUMENTS

| | | |
|---|---|---|
| DE | 1 040 421 | 10/1958 |
| DE | 20 2004 019 504 U1 | 5/2006 |

* cited by examiner

*Primary Examiner*—Troy Chambers
*Assistant Examiner*—Samir Abdosh
(74) *Attorney, Agent, or Firm*—Laurence A. Greenberg; Werner H. Stemer; Ralph E. Locher

(57) ABSTRACT

A penetration-capable projectile has a casing and a fuze with a fuze housing lower part. An interface area between the casing of the projectile and the fuze housing lower part is formed with a shape and/or strength modification which prevents the fuze housing lower part from being pushed into the casing on impact with a target that is to be penetrated.

24 Claims, 9 Drawing Sheets

PROJECTILE WITH A PENETRATION CAPABILITY

CROSS-REFERENCE TO RELATED APPLICATIONS

This application claims the priority, under 35 U.S.C. § 119, of German patent applications DE 10 2007 016 488.4, filed Apr. 5, 2007 and DE 20 2008 002 145.6, filed Feb. 15, 2008; the prior applications are herewith incorporated by reference in their entirety.

BACKGROUND OF THE INVENTION

Field of the Invention

The invention relates to a penetration-capable projectile with a fuze.

Concrete-breaking projectiles, for example mortar or artillery projectiles, normally have a mechanical impact fuze (also: "fuse"). The penetration capability of projectiles can be improved by multifunction fuzes. These are intended to be able to initiate detonation even after the projectile has passed through a concrete target.

BRIEF SUMMARY OF THE INVENTION

It is an object of the invention to provide a penetration-capable projectile, which overcomes various disadvantages of the heretofore-known devices and methods of this general type and in which a penetration capability through a target is achieved by a subsequent detonation function.

With the foregoing and other objects in view there is provided, in accordance with the invention, a penetration-capable projectile, comprising:

a casing; and a fuze with a fuze housing lower part mounted to said casing at an interface area; and at least one of a shape modification and a strength modification formed at said interface area between said casing and said fuze housing lower part configured to prevent said fuze housing lower part from being pushed into said casing upon impacting a target to be penetrated.

In other words, the above and other objects are achieved by a projectile with a penetration capability, having a casing and a fuze which has a fuze housing lower part, in which, according to the invention, a shape and/or strength modification is formed in an interface area between the casing and the fuze housing lower part in order to prevent the fuze housing lower part from being pushed into the casing on impact with a target that is to be penetrated.

In accordance with a preferred embodiment of the invention, the projectile includes a mouth hole head ring disposed at said interface area, said mouth hole head ring having a first internally threaded section on a casing side and a second internally threaded section on a fuze side, said second internally threaded section having a smaller thread diameter than said first internally threaded section, and wherein a conically tapered transition, substantially without an undercut, is formed between said first internally threaded section and said second internally threaded section.

The projectile according to the invention allows multifunctionality assemblies to be protected whose function is required immediately after target impact. This includes, for example, operation of a safety and arming unit with a firing chain. The assemblies which are no longer relevant and have already carried out their function on impact with the target may be destroyed on impact and, for example, are located in front of the projectile structure with a penetration capability.

The projectile with a penetration capability is preferably a mortar round, also referred to in the following text as a projectile, or an artillery projectile. The fuze housing lower part is that part of the fuze which faces the casing, with the tip of the projectile being regarded as being at the top. The interface area is the area in which the fuze or its lower part is connected to the casing, that is to say for example that part of the projectile which contains the warhead. The shape and/or strength modification is a means for preventing the fuze housing lower part from being pushed in the direction of the casing or transversely with respect to the casing, in which case the prevention need not be regarded as absolute in all conditions. The prevention of being pushed in means, for example, that sufficient space is available for a multifunction unit even after impact, in order to remain functional and to initiate detonation.

The shape and/or strength modification means that there is no need for an undercut, as is normally provided at the end of a thread in order to simplify thread cutting. A mouth hole head ring is expediently arranged in the interface area, with a first internally threaded section on the casing side and a second internally threaded section with a smaller thread diameter on the fuze side, with a transition being formed between the first and the second internally threaded section, without an undercut and as a conical taper. Very good dimensional stability can be achieved even on impact with a target, allowing the functionality of a detonation mechanism to be maintained. The fuze housing lower part may be screwed into the mouth hole head ring.

The shape and/or strength modification may be a weak point, in a further embodiment of the invention. For this purpose, the fuze housing lower part is provided with a weak point. It is possible to prevent an excessive force from being transmitted to a housing of a physical space for a detonation mechanism, and the housing can be protected.

For this purpose, the weak point is advantageously provided on the transition area between a housing structure, which is destroyed on impact, and a housing structure, which is relevant for penetration, of the fuze housing lower part.

The weak point can be manufactured particularly easily by having a groove which is circumferential around an outer surface of the fuze housing lower part, or being formed as such.

On impact of the projectile, very high forces are exerted on the fuze housing and can result in a component spreading out, or in lateral movement of a component against an adjacent component. This weakens the housing, as a result of which a physical space for a firing chain may not remain intact, or other malfunctions may occur. Spreading out or lateral movement can be counteracted by arranging an interlocking element on, and in particular in, an end surface of the interface area.

The fuze for an artillery projectile is normally sufficiently large that it can be screwed directly into a mouth hole of the projectile. There is no need for a mouth hole head ring as a type of adapter for a relatively small fuze. In this embodiment of the projectile, a particularly good effect against spreading or movement can be achieved by arranging the interlocking element on an end surface which faces an end surface of a mouth hole of the casing. In particular, the fuze housing lower part of the fuze is screwed directly into a mouth hole in the casing, and is formed with an interlocking element which is circumferential around the fuze housing lower part and rests on an end surface of the mouth hole.

The interlocking element advantageously has a claw system for digging into an opposite element on impact with the target, in particular into an opposite surface of the element. This prevents the elements from sliding with respect to one another.

The interlocking element is expediently provided in order to counteract radial widening of the end surface in which it is incorporated or on which it is arranged, or radial movement of the end surface with respect to an adjacent element.

If the interlocking element is formed on an annular end surface, movement along the entire circumference can be prevented.

In the case of a mortar round, the fuze is normally connected to an ogive, that is to say to a warhead housing, via a mouth hole head ring. In this embodiment, the interlocking element is advantageously arranged on an end surface of a mouth hole head ring. This makes it possible to prevent movement of the mouth hole head ring with respect to the casing.

A large-area interlocking element can be achieved using only a small amount of material by forming it on a collar which is circumferential around the fuze housing lower part.

If the interlocking element is formed from a plurality of grooves, this makes it possible to ensure that the grooves dig into an opposite component on impact, thus holding the two components very firmly against one another. The grooves and projections located between them can therefore be used as gripping claws.

The mutual retention is particularly firm if the interlocking element is formed from two opposite groove structures which engage in one another.

In a further embodiment of the invention, the interlocking element has mutually concentric projections which are circumferential in an annular shape. This makes it possible to provide support along the entire circumference. The projections may be grooves or projections located between them.

The annular projections expediently have a pointed profile for gripping an opposite component.

If the annular projections are separated from one another by different radial distances, then this makes it possible on the one hand to ensure that the interlocking element is particularly resistant to destruction while on the other hand ensuring that the interlocking element is held particularly well on the opposite component. The different distances may in this case be measured from the points of the projections.

Other features which are considered as characteristic for the invention are set forth in the appended claims.

Further advantages will become evident from the following description of the drawing, which illustrates exemplary embodiments of the invention. The drawing and the description contain numerous features in combination, which a person skilled in the art will also expediently consider individually and combine to make worthwhile further combinations.

Although the invention is illustrated and described herein as embodied in projectile with a penetration capability, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
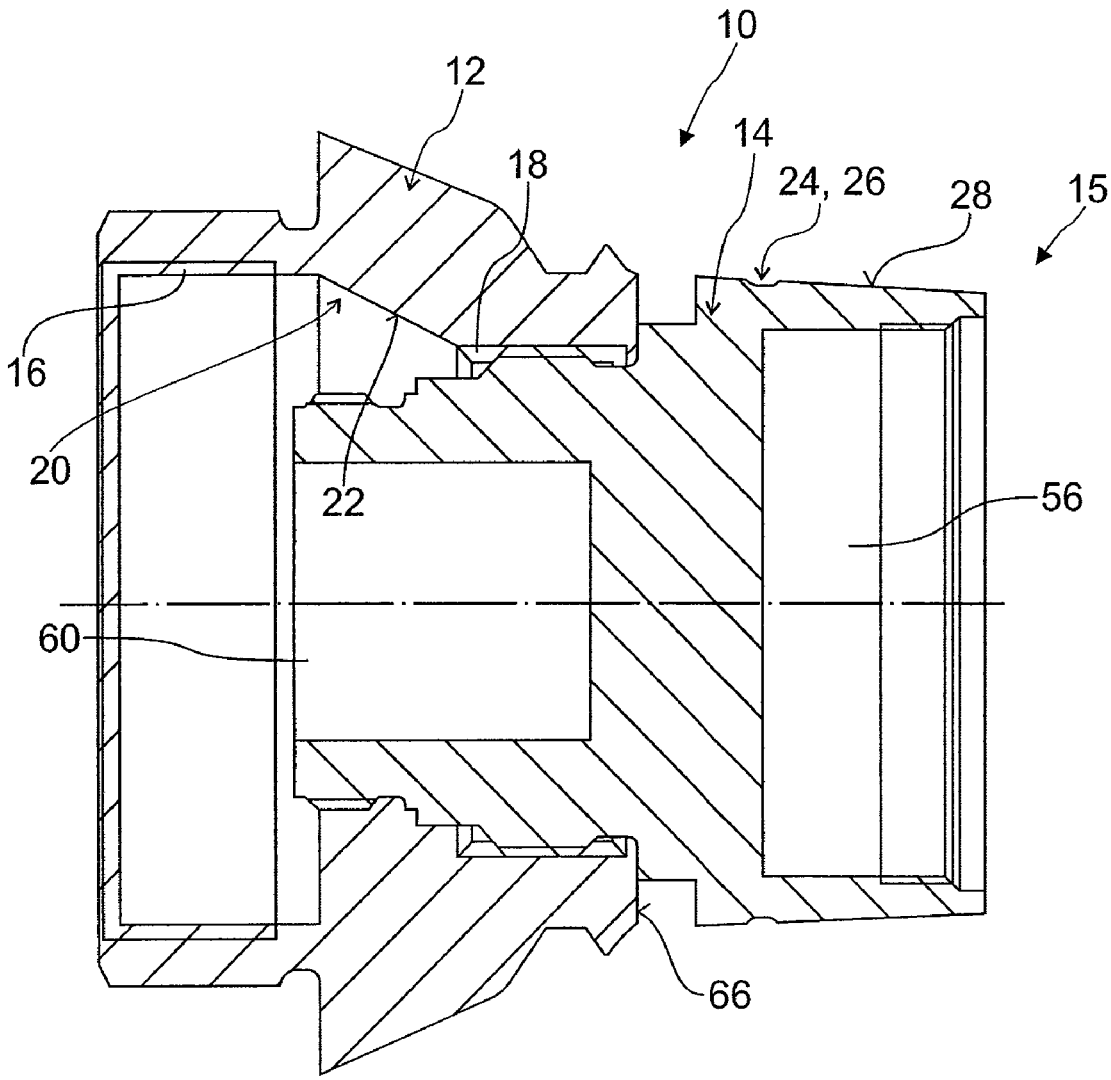
FIG. 1 is a longitudinal section taken through a mouth hole head ring and a fuze housing lower part of a mortar round in the assembled state.

Referring now to the figures of the drawing in detail and first, particularly, to FIG. 1 thereof, there is shown a longitudinal section through major parts of a penetration-capable projectile 10, in this case a mortar round. The projectile 10 has a mouth hole head ring 12 and a fuze housing lower part 14 (see also FIG. 2) of a fuze 15, which are screwed to one another.

The mouth hole head ring 12 has a first internally threaded section 16 on the casing side, for example for screwing in a booster charge, and a second internally threaded section 18 on the fuze side. The second internally threaded section 18 has a smaller thread diameter than the first internally threaded section 16. A transition 20 between the internally threaded sections 16, 18 is formed without an undercut—as is normally the case with known mouth hole head rings for mortar rounds—but with a conical taper 22, thus resulting in the mouth hole head ring 12 being reinforced as a shape and/or strength modification at the said transition 20, instead of the material being weakened by an undercut.

Figure 2:
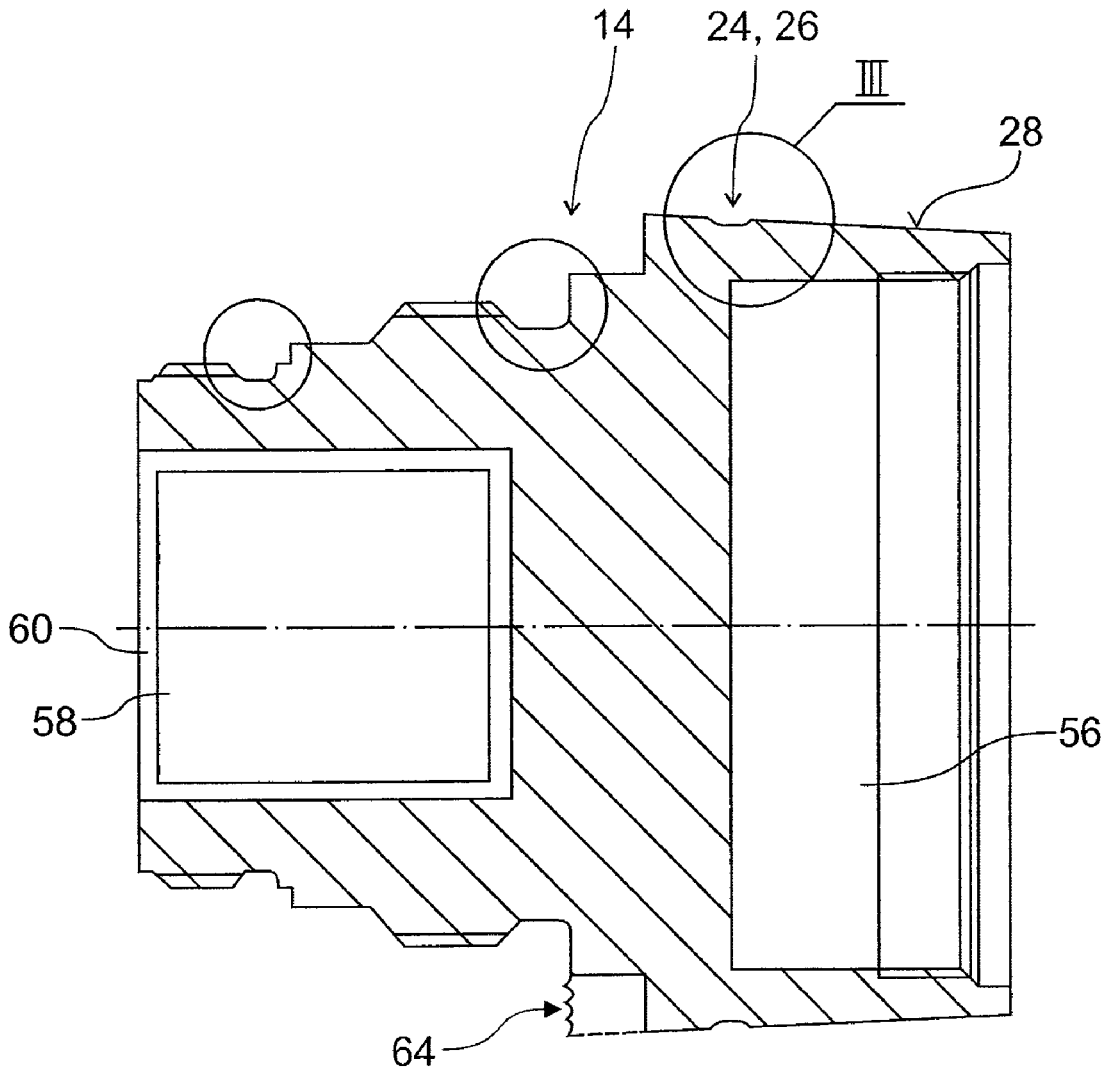
FIG. 2 is a similar view of the fuze housing lower part from FIG. 1.
Figure 3:
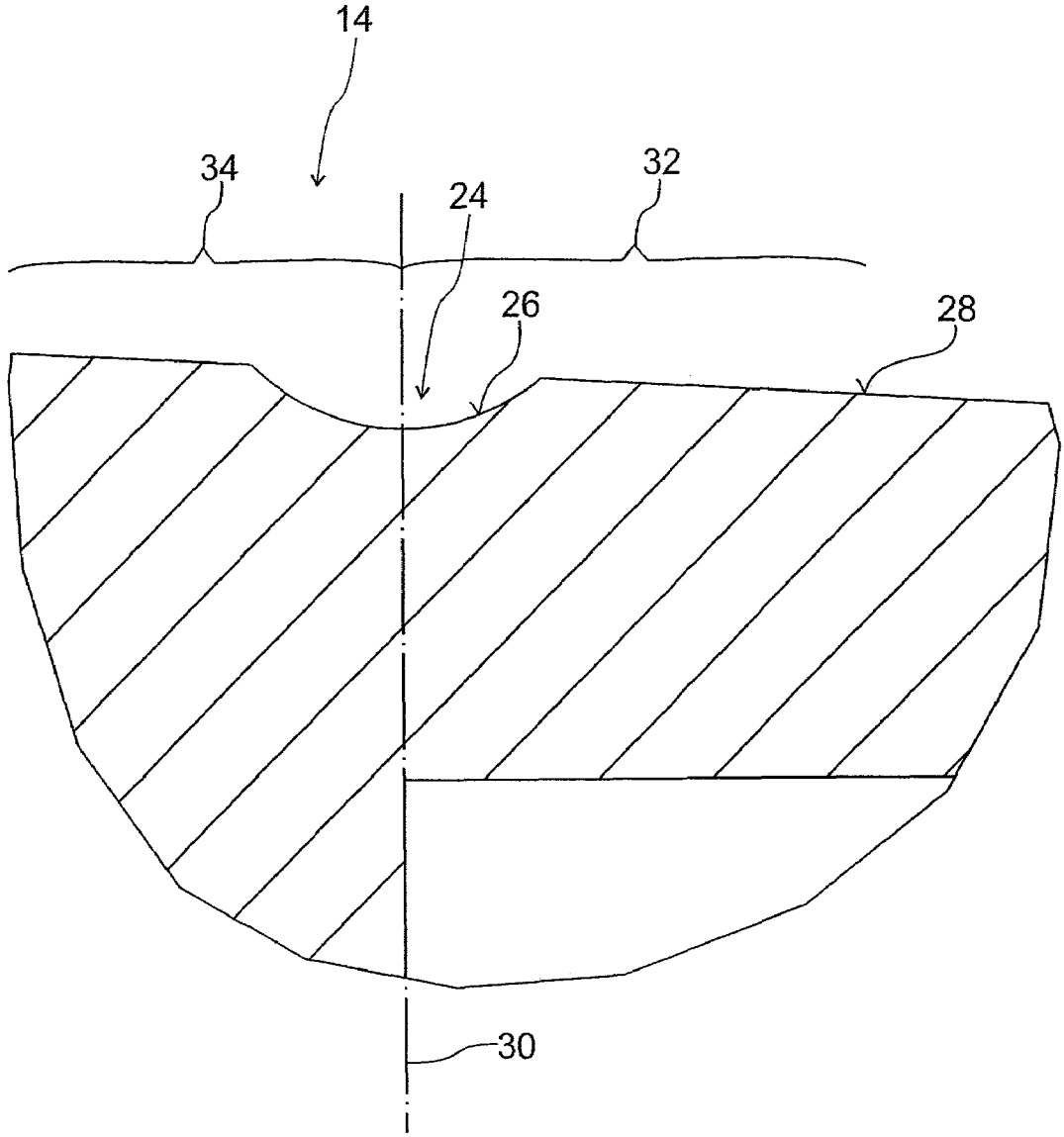
FIG. 3 is an enlarged partial view of detail III in FIG. 2.

The fuze housing lower part 14 is screwed into the mouth hole head ring 12 and has a weak point 24 (i.e., a predetermined breaking point 2) as a further shape and/or strength modification. As is shown in FIG. 2, and in particular in FIG. 3, the weak point 24 is in the form of a circumferential groove 26 in an outer surface 28 of the fuze housing lower part 14. The groove 26 is arranged on the transition area, which is indicated in FIG. 3 by a dashed-dotted line 30, between a housing structure 32 and a housing structure 34 of the fuze housing lower part 14. By way of example, the housing structure 32 contains means for a proximity function and a battery, and may be destroyed on impact of the projectile. The housing structure 34 is intended to remain as intact as possible after impact, in order for example to protect a firing chain arranged in it.

Figure 4:
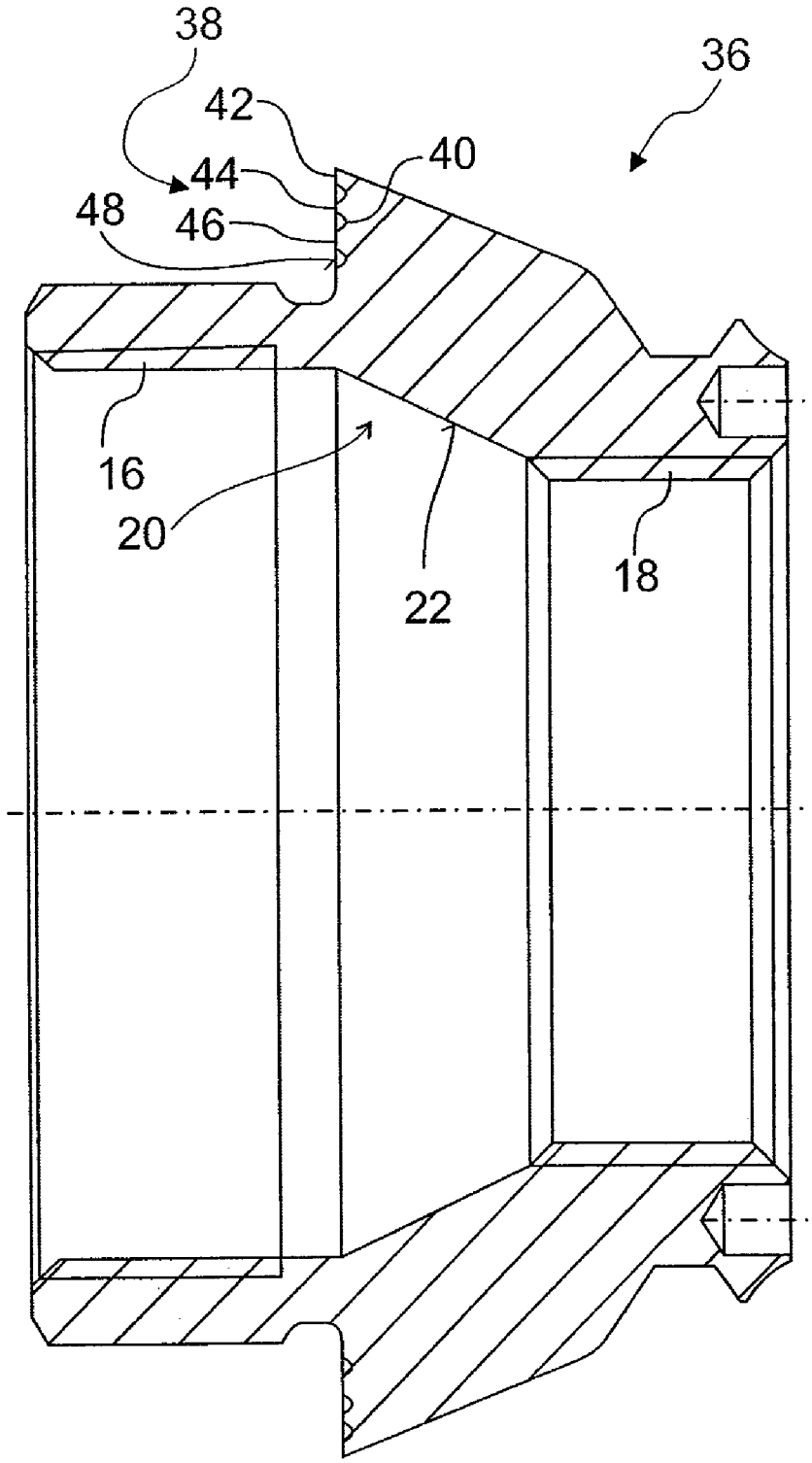
FIG. 4 is a longitudinal section through a further mouth hole head ring.

FIG. 4 shows a further mouth hole head ring 36—without a fuze housing lower part 14 screwed into it. The following description is essentially restricted to differences from the exemplary embodiment in FIGS. 1 to 3, to which reference is made with regard to features and functions which remain unchanged. Components which remain essentially unchanged are in principle annotated with the same reference symbols.

Figure 5:
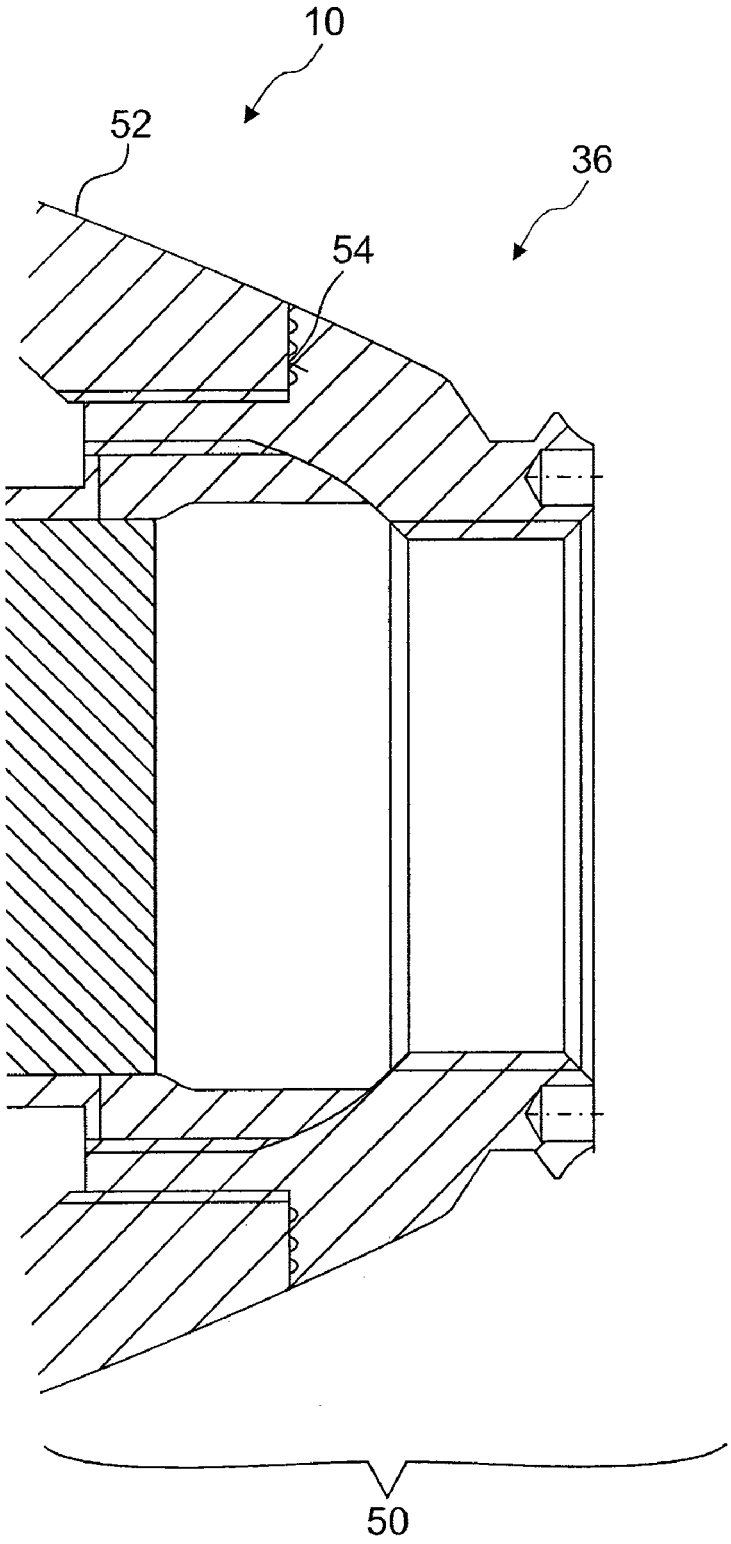
FIG. 5 shows the mouth hole head ring from FIG. 4 on a casing of a mortar round.

The mouth hole head ring 36 as a shape and/or strength modification has an interlocking element 38 which is in the form of three circumferential grooves 40 with adjacent points 42, 44, 46. The interlocking element 38 is incorporated in an end surface 48 of the mouth hole head ring 36, which end surface 48 is arranged in an interface area 50 between a casing 52 of the projectile 10 and the fuze housing lower part 14. The end surface 48 is located opposite an end surface 54 of the casing 52, as illustrated in FIG. 5, with the two end surfaces 48, 54 resting on one another.

On impact of the projectile 10 with a target, large forces initially act on the fuze 15 whose front plastic part which is not illustrated, breaks up and releases the fuze housing lower part 14. The annular upper end of the fuze housing lower part 14 bores into the target and cuts itself in there like a drill bit. In the process, components in a physical space 56 between this annular upper end, for example proximity electronics and a battery, are destroyed. However, the battery will have emitted sufficient energy to a component 58, for example a firing chain, which is illustrated schematically in FIG. 2 that it remains operable with the energy that has been transferred to it and, for example, can be initiated after a predetermined delay time.

The impact forces are transmitted from the fuze housing lower part 14 to the mouth hole head ring 12, 36 and from there to the casing 52 of the projectile 10. If the forces exceed a specific value, then the fuze housing lower part 14 breaks at the weak point 24 for further penetration. A physical space 60 for the component 58 remains intact during this process. Particularly if the projectile 10 does not strike the target at right angles, large shear forces now act on the interface area 50 and can lead to radial and axial movement of the mouth hole head ring 12, 36 relative to the casing 52 in such a way, for example, that a firing chain is no longer optimally directed at a booster charge 62 or other malfunctions can occur.

This movement is counteracted by the interlocking element 38. Its points 42, 44, 46 dig into the opposite end surface 54 and thus form an interlock, produced by impact forces, between the mouth hole head ring 36 and the casing 52. Alternatively, an analogous interlocking element in a negative form with respect to the interlocking element 38 can also be incorporated in the end surface 54, so that the interlock exists even before impact. It is also feasible to provide an interlocking element only in the end surface 54, that is to say on the projectile side, instead of the interlocking element 38 which is provided on the mouth hole head ring 36 side.

On impact, large lateral forces may act on the points 42, 44, 46 which are buried in the end surface 54, and can lead to destruction of the points 42, 44, 46. In order to ensure that the points 42, 44, 46 have good resistance to destruction, the points 42, 44, 46 and the grooves 40 are at different distances from one another in the radial direction. For example, the ratio of the distance between the inner points 44, 46 to the distance between the outer points 42, 44 is 5 to 3. This also applies to the deepest points of the grooves 40 with respect to one another. In order to allow the points 42, 44, 46 to be relatively large and nevertheless to provide a plurality of points 42, 44, 46 with a different effect as a result of the different distances, the interlocking element 38 expediently has between two and five grooves, in particular three grooves 40, as is illustrated in FIG. 4.

In order to prevent movement of the fuze housing lower part 14 with respect to the mouth hole head ring 12, 36, an interlocking element 64 can also be incorporated in the interface area 50 between the fuze housing lower part 14 and the mouth hole head ring 12, 36, as is indicated by a dashed line in FIG. 2. It would be just as possible to incorporate the interlocking element in an opposite end surface 66 of the mouth hole head ring 12, 36, or at both points for mutual engagement.

Figure 6:
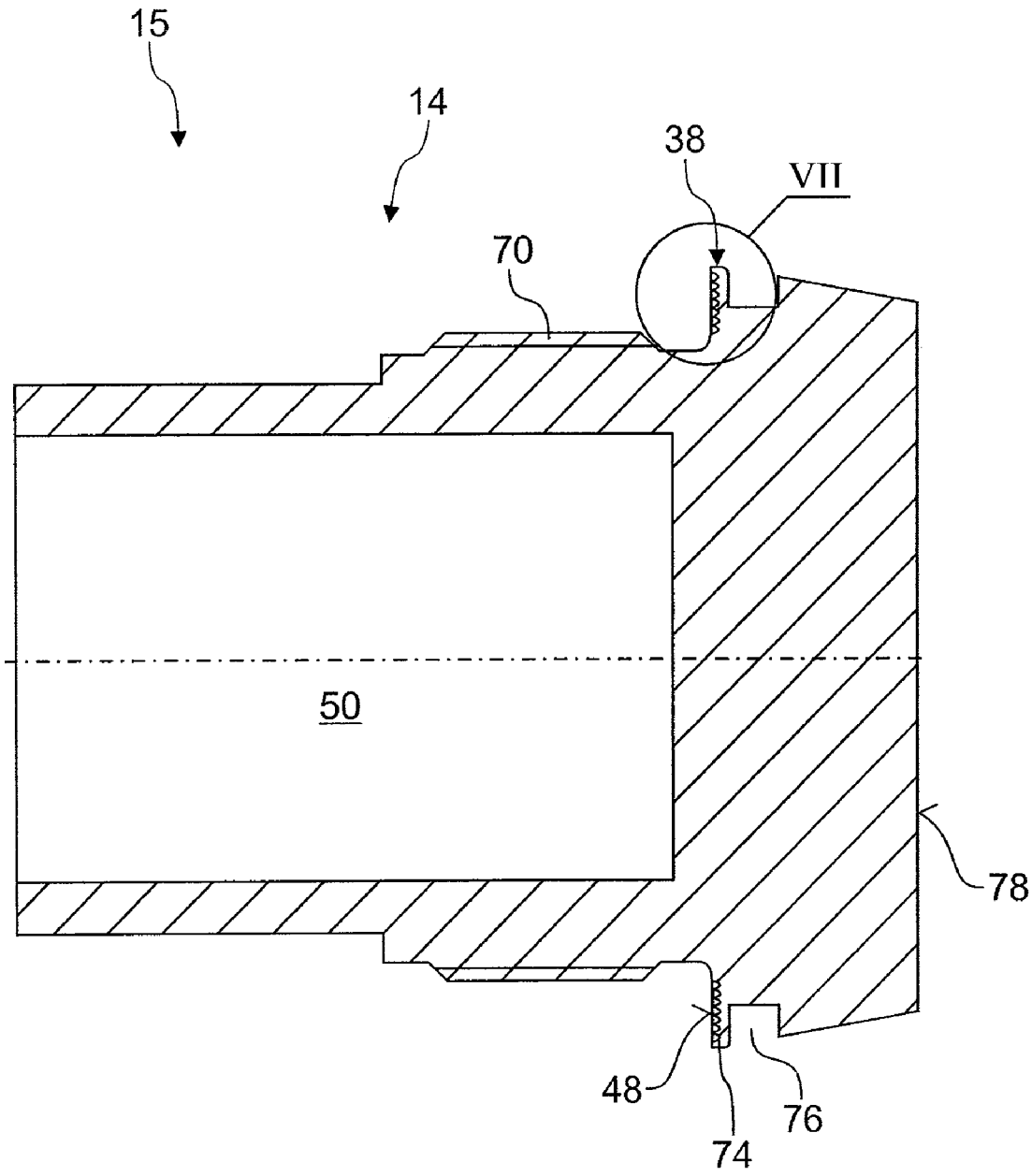
FIG. 6 is a longitudinal section through a fuze housing lower part of an artillery projectile.

FIG. 6 shows a longitudinal section through a fuze housing lower part 14 of a fuze 15 for an artillery projectile with a penetration capability. Artillery projectiles normally have no mouth hole head ring, but the fuze can be screwed directly into the mouth hole 68 of the casing 52 of the artillery projectile. For this purpose, the fuze housing lower part 14 is formed with an externally threaded section 70 for screwing into an internal thread 72 in the casing 52 of the artillery projectile.

The fuze housing lower part 14 is formed with an interlocking element 38 (see also FIG. 7) which may be formed on a collar 74 at the side of a key recess 76 for a screw connection. The collar 74 has an annular end surface 48 which, when the artillery projectile has been assembled, rests on the end surface 54 of the mouth hole 68 of the artillery projectile and, as described, is buried there on impact. It would also be feasible in this case, alternatively or additionally, to provide an interlocking element on the end surface 54 of the mouth hole 68, in particular to form an interlock even before impact. However, this may also be omitted, for example because of standardization regulations.

Figure 7:
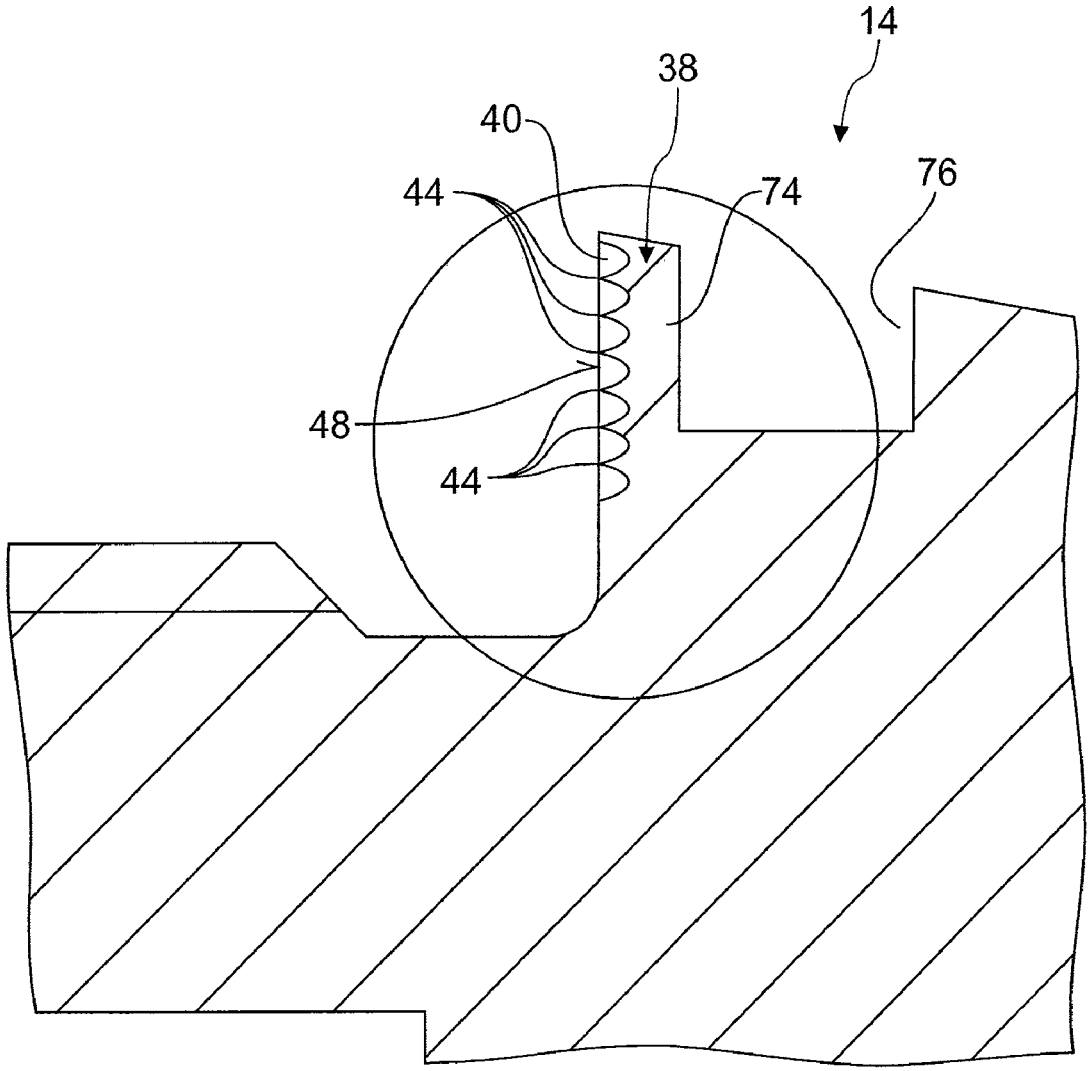
FIG. 7 is an enlarged partial view of the detail VII in FIG. 6.
Figure 8:
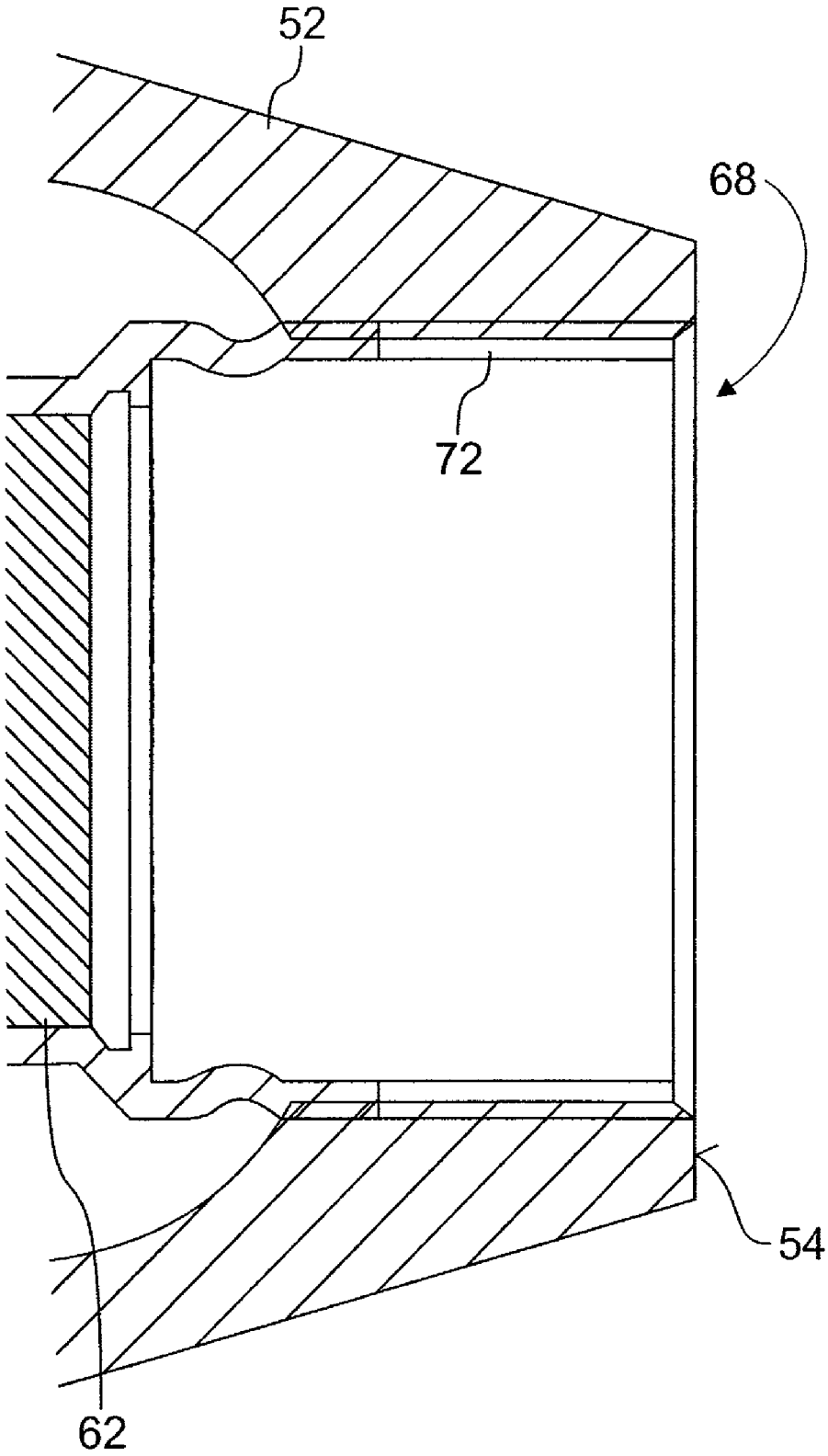
FIG. 8 is a longitudinal section through a casing of an artillery projectile for holding the fuze housing lower part of FIG. 6.

As can be seen particularly clearly in FIG. 6, the end surface 48 of the interlocking element 38 is likewise formed with mutually concentric projections, which are circumferential in an annular shape, in the form of points 44. FIGS. 6 and 7 each show seven grooves 40, although in this case fewer grooves 40 with corresponding points 44 also offer particularly good resistance to movement.

The interlocking element 38 of the fuze housing lower part 14 is in each case provided to prevent movement of the fuze housing lower part 14 into the casing 52—either directly in the opposite direction to the direction of flight or indirectly by radial movement or possibly rotation about an axis laterally with respect to the direction of flight or tilting in this case—on impact of the projectile with a target to be penetrated. As described, on impact with a target, the interlock is produced by the mutually concentric projections, which are circumferential in an annular shape, with their pointed profile, with the projections, which have pointed profiles and are circumferential in an annular shape, being forced into the end surface 48, 54, 66 that has been mentioned. This interlock also prevents undesirable widening of the mouth hole 68 or mouth hole head ring 12, 36 and thus undesirable pushing in. At the same time, this improves the force transmission into the casing 52 of the projectile.

One major advantage of the interlocking element 38 is that standardized interfaces between the casing 52 and the mouth hole head ring 36 and/or fuze housing lower part 14 can remain unchanged because the fuze housing lower part 14 does not exceed the maximum permissible shape and/or dimension discrepancies.

Figure 9:
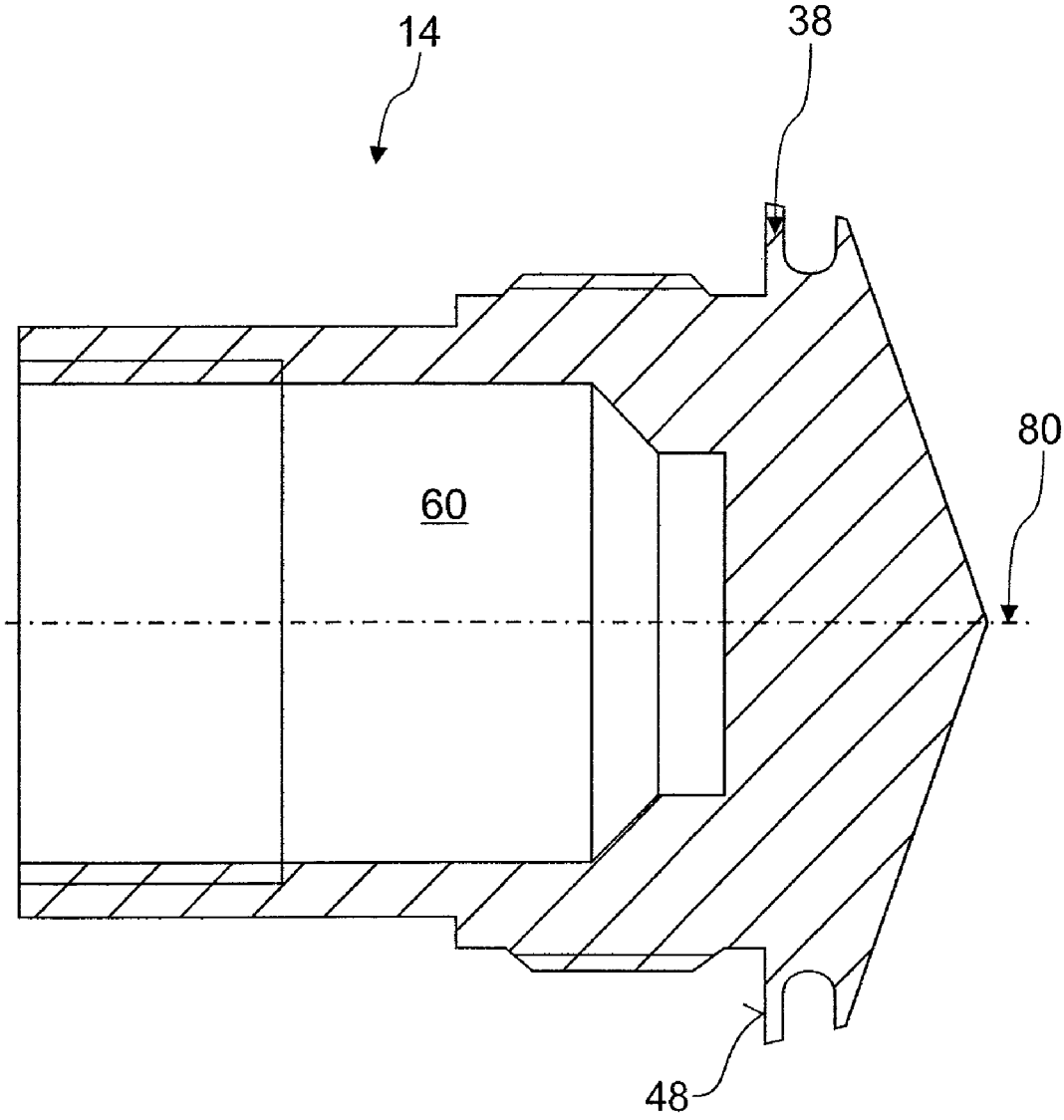
FIG. 9 is a longitudinal section through another embodiment of the fuze housing lower part of an artillery projectile.

While FIG. 6 shows a fuze housing lower part 14 of an artillery projectile with a flat impact surface 78, FIG. 9 shows a longitudinal section through an embodiment of the housing lower part 14 of an artillery projectile with penetration capability, which is formed with a flat conical tip 80. A physical space or free space for the safety and arming unit that is required is also shown in FIG. 9, annotated with the reference number 60.

In order to achieve the desired penetration capability, appropriate mechanical strength is also required, that is to say the structure must not be too soft or too hard; it must have high strength and good resistance to impact and notching.

The invention claimed is:

1. A penetration-capable projectile, comprising:

a casing;

a fuze with a fuze housing lower part mounted to said casing at an interface area;

at least one of a shape modification and a strength modification formed at said interface area between said casing and said fuze housing lower part configured to prevent said fuze housing lower part from being pushed into said casing upon impacting a target to be penetrated; and a mouth hole head ring disposed at said interface area, said mouth hole head ring having a first internally threaded section on a casing side and a second internally threaded section on a fuze side, said second internally threaded section having a smaller thread diameter than said first internally threaded section, and wherein a conically tapered transition, substantially without an undercut, is formed between said first internally threaded section and said second internally threaded section.

2. The projectile according to claim 1, wherein said fuze housing lower part is formed with a predetermined breaking point.

3. The projectile according to claim 2, wherein said predetermined breaking point is a weak point formed on a transition area between a housing structure to be destroyed on impact, and a housing structure, relevant for penetration, of said fuze housing lower part.

4. The projectile according to claim 2, wherein said predetermined breaking point includes a groove formed circumferentially around an outer surface of said fuze housing lower part.

5. The projectile according to claim 1, which comprises an interlocking element on an end surface of said interface area.

6. The projectile according to claim 5, wherein said casing is formed with a mouth hole having an end surface, said fuze housing lower part of said fuze is screwed directly into said mouth hole, and said interlocking element is formed circumferentially around said fuze housing lower part and rests on said end surface of said mouth hole.

7. The projectile according to claim 5, wherein said interlocking element is arranged on an end surface of said fuze housing lower part facing an end surface of a mouth hole of said casing.

8. The projectile according to claim 5, wherein said interlocking element comprises a claw system for digging into an opposite element on impact with the target.

9. The projectile according to claim 5, wherein said interlocking element is configured to counteract a radial widening of said end surface.

10. The projectile according to claim 5, wherein said interlocking element is formed on an annular end surface of said fuze lower housing part.

11. The projectile according to claim 5, which comprises a mouth hole head ring at a mouth of said casing, and wherein said interlocking element is formed on an end surface of said mouth hole head ring.

12. The projectile according to claim 5, wherein said interlocking element is formed of a plurality of grooves.

13. The projectile according to claim 5, wherein said interlocking element is formed of two mutually opposite groove structures that engage in one another.

14. The projectile according to claim 5, wherein said interlocking element includes mutually concentric, annularly circumferential projections.

15. The projectile according to claim 14, wherein said annular projections have a pointed profile.

16. The projectile according to claim 14, wherein said annular projections are separated from one another by mutually different radial distances.

17. The projectile according to claim 1, wherein said fuze housing lower part is formed with a flat conical tip.

18. The projectile according to claim 1, wherein said fuze housing lower part is composed of high-strength, ductile material.

19. A penetration-capable projectile, comprising:

a casing;

a fuze with a fuze housing lower part mounted to said casing at an interface area;

at least one of a shape modification and a strength modification formed at said interface area between said casing and said fuze housing lower part configured to prevent said fuze housing lower part from being pushed into said casing upon impacting a target to be penetrated;

wherein said fuze housing lower part is formed with a weak point forming a predetermined breaking point on a transition area between a housing structure to be destroyed on impact, and a housing structure, relevant for penetration, of said fuze housing lower part.

20. A penetration-capable projectile, comprising:

a casing having a longitudinal axis; and a fuze with a fuze housing lower part mounted to said casing at an interface area; and an interlocking element, in the form of at least one of a shape modification and a strength modification, configured to prevent said fuze housing lower part from being pushed into said casing and to counteract spreading out or lateral movement of said fuze housing lower part upon impacting a target to be penetrated, said interlocking element being formed at one or two end surfaces extending substantially perpendicular to said longitudinal axis at said interface area.

21. The projectile according to claim 20, wherein said interlocking element is provided at one or both front surfaces between a mouth hole head ring and said casing, between said fuze housing lower part and said casing, and/or between said fuze housing lower part and a mouth hole head ring.

22. The projectile according to claim 20, wherein said interlocking element includes mutually concentric, annularly circumferential projections separated from one another by mutually different radial distances.

23. A penetration-capable projectile, comprising:

a casing having a longitudinal axis;

a mouth hole head ring mounted to a mouth of said casing;

a fuze with a fuze housing lower part mounted to said mouth hole head ring; and an interlocking element formed at an interface between said casing and said mouth hole head ring and/or at an interface between said fuze housing lower part and said mouth hole head ring, said interlocking element being configured to prevent said fuze housing lower part from being pushed into said casing or into said mouth hole head ring and to counteract spreading out or lateral movement of said fuze housing lower part upon impacting a target to be penetrated, said interface with said interlocking element extending substantially perpendicular to said longitudinal axis of said casing.

24. The projectile according to claim 23, wherein said interlocking element is provided at one or both facing surfaces between said mouth hole head ring and said casing, between said fuze housing lower part and said casing, and/or between said fuze housing lower part and said mouth hole head ring, wherein said facing surfaces extend substantially perpendicular to said longitudinal axis of said casing.

* * * * *